US010453599B2

(12) United States Patent
Noguchi et al.

(10) Patent No.: US 10,453,599 B2
(45) Date of Patent: Oct. 22, 2019

(54) MAGNETIC CORE, METHOD FOR PRODUCING MAGNETIC CORE, AND COIL COMPONENT

(71) Applicant: Hitachi Metals, Ltd., Tokyo (JP)

(72) Inventors: Shin Noguchi, Mishima-gun (JP); Kazunori Nishimura, Mishima-gun (JP); Toshio Mihara, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/326,071

(22) PCT Filed: Jul. 16, 2015

(86) PCT No.: PCT/JP2015/070345

§ 371 (c)(1),
(2) Date: Jan. 13, 2017

(87) PCT Pub. No.: WO2016/010098

PCT Pub. Date: Jan. 21, 2016

(65) Prior Publication Data

US 2017/0207017 A1 Jul. 20, 2017

(30) Foreign Application Priority Data

Jul. 16, 2014 (JP) ..... 2014-146100

(51) Int. Cl.
*H01F 27/255* (2006.01)
*H01F 1/20* (2006.01)
(Continued)

(52) U.S. Cl.
CPC ..... *H01F 27/255* (2013.01); *H01F 1/14791* (2013.01); *H01F 1/20* (2013.01);
(Continued)

(58) Field of Classification Search
CPC ..... H01F 27/00–255
(Continued)

(56) References Cited

U.S. PATENT DOCUMENTS 5,228,185 A * 7/1993 Higashihara ..... G11B 5/1276 29/603.18
8,328,955 B2 * 12/2012 Wakabayashi ..... C22C 38/34 148/104

(Continued)

FOREIGN PATENT DOCUMENTS

JP 8-203718 A 8/1996
JP 2006-147959 A 6/2006

(Continued)

OTHER PUBLICATIONS

International Preliminary Report on Patentability and translation of Written Opinion dated Jan. 26, 2017 from the International Bureau in counterpart International Application No. PCT/JP2015/070345.

(Continued)

*Primary Examiner* — Tuyen T Nguyen
(74) *Attorney, Agent, or Firm* — Sughrue Mion, PLLC

(57) ABSTRACT

There is provided a magnetic core having high manufacturability and high magnetic permeability, to provide a method for manufacturing such a magnetic core, and to provide a coil component having such a magnetic core. The invention is directed to a magnetic core including: Fe-based soft magnetic alloy particles; and an oxide phase existing between the Fe-based soft magnetic alloy particles, wherein the Fe-based soft magnetic alloy particles include Fe—Al—Cr alloy particles and Fe—Si—Al alloy particles.

10 Claims, 10 Drawing Sheets

(51) Int. Cl.

| | |
|---|---|
| ***H01F 1/24*** | (2006.01) |
| ***H01F 1/147*** | (2006.01) |
| ***H01F 27/28*** | (2006.01) |
| ***H01F 41/02*** | (2006.01) |
| ***H01F 3/08*** | (2006.01) |
| ***H01F 17/04*** | (2006.01) |
| *H01F 27/29* | (2006.01) |

(52) U.S. Cl.
CPC ..... *H01F 1/24* (2013.01); *H01F 3/08* (2013.01); *H01F 17/045* (2013.01); *H01F 27/2823* (2013.01); *H01F 41/0246* (2013.01); *H01F 27/292* (2013.01)

(58) Field of Classification Search
USPC ..... 336/65, 83, 200, 212, 233–234
See application file for complete search history.

(56) References Cited

U.S. PATENT DOCUMENTS

| | | | | |
|---|---|---|---|---|
| 9,978,504 | B2 * | 5/2018 | Narisawa | H01F 27/2823 |
| 2005/0176885 | A1 * | 8/2005 | Sekiba | C08K 5/5425 524/863 |
| 2007/0252771 | A1 * | 11/2007 | Maezawa | G06K 19/07771 343/841 |
| 2008/0257599 | A1 * | 10/2008 | Matsushita | H01Q 17/00 174/390 |
| 2011/0227690 | A1 | 9/2011 | Watanabe et al. | |
| 2011/0267167 | A1 | 11/2011 | Ogawa et al. | |
| 2011/0272622 | A1 * | 11/2011 | Wakabayashi | C21D 6/008 252/62.55 |
| 2012/0038449 | A1 | 2/2012 | Ogawa et al. | |
| 2012/0188040 | A1 * | 7/2012 | Ogawa | H01F 27/027 336/83 |
| 2012/0274433 | A1 * | 11/2012 | Matsumoto | H01F 27/292 336/192 |
| 2013/0200970 | A1 | 8/2013 | Ogawa et al. | |
| 2015/0002255 | A1 * | 1/2015 | Kim | H01F 27/255 336/233 |
| 2015/0035635 | A1 * | 2/2015 | Hayashi | H01F 17/045 336/192 |
| 2015/0294780 | A1 * | 10/2015 | Maeda | H01F 17/0013 336/200 |
| 2016/0336104 | A1 * | 11/2016 | Noguchi | C22C 33/0264 |
| 2017/0018343 | A1 * | 1/2017 | Nishimura | C22C 33/0257 |
| 2017/0178775 | A1 * | 6/2017 | Noguchi | B22F 5/00 |

FOREIGN PATENT DOCUMENTS

| | | | |
|---|---|---|---|
| JP | 2006-237153 | A | 9/2006 |
| JP | 2010-272608 | A | 12/2010 |
| JP | 2011-249836 | A | 12/2011 |
| JP | 2013-98384 | A | 5/2013 |
| WO | 2010/082486 | A1 | 7/2010 |

OTHER PUBLICATIONS

Communication dated Mar. 26, 2018 from the European Patent Office in counterpart European application No. 15822500.3.
Communication dated Dec. 5, 2017, issued by the Japanese Patent Office in counterpart Japanese Application No. 2016-534481.
Communication dated Jan. 17, 2018 from the State Intellectual Property Office of the P.R.C. in counterpart Application No. 201580038029.1.
Communication dated Feb. 27, 2018 from the Korean Intellectual Property Office in counterpart Application No. 10-2017-7002438.

* cited by examiner

MAGNETIC CORE, METHOD FOR PRODUCING MAGNETIC CORE, AND COIL COMPONENT

CROSS REFERENCE TO RELATED APPLICATIONS

This application is a National Stage of International Application No. PCT/JP2015/070345, filed on Jul. 16, 2015 (which claims priority from Japanese Patent Application No. 2014-146100, filed on Jul. 16, 2014), the contents of which are incorporated herein by reference in their entirety.

TECHNICAL FIELD

The invention relate to a magnetic core, a method for manufacturing a magnetic core, and a coil component.

BACKGROUND ART

Traditionally, coil components such as inductors, transformers, and chokes are used in a wide variety of applications such as home electric appliances, industrial apparatuses, and vehicles. A coil component is composed of a magnetic core and a coil wound around the magnetic core. Such a magnetic core often includes ferrite, which is superior in magnetic properties, freedom of shape, and cost.

In recent years, as a result of downsizing of power supplies for electronic devices, there has been a strong demand for compact low-profile coil components operable even with a large current, and magnetic cores produced with a metallic magnetic powder, which has a saturation magnetic flux density higher than that of ferrite, are increasingly used for such coil components. Such a metallic magnetic powder includes, for example, a magnetic alloy powder such as an Fe—Si alloy powder or an Fe—Ni alloy powder. Although having high saturation magnetic flux density, magnetic cores obtained through the compaction of the magnetic alloy powder compact have low electrical resistivity due to the use of the alloy powder. Therefore, the magnetic alloy powder to be used is provided with an insulating coating in advance. For this problem, there is proposed a technique for imparting insulting properties to a magnetic core by oxidizing soft magnetic alloy particles including iron, silicon, and an element more vulnerable to oxidation than iron (such as chromium or aluminum) to form an oxide layer on the surface of the particles (see Patent Document 1).

It is also known that when produced with Fe—Si—Al alloy particles, magnetic cores can have reduced iron loss. Since the Fe—Si—Al alloy particles are relatively hard and low in deformability (formability), magnetic cores produced with such particles tend to have more voids between the particles and to have lower magnetic permeability. Thus, there is proposed a technique for increasing magnetic permeability by using Fe—Si—Al alloy particles in combination with highly-compressible Fe—Ni alloy particles, in which these particles are provided with an insulating coating in advance, respectively (see Patent Document 2).

PRIOR ART DOCUMENTS

Patent Documents

Patent Document 1: JP-A-2011-249836
Patent Document 2: JP-A-2013-98384

SUMMARY OF THE INVENTION

Problems to be Solved by the Invention

The technique using two types of soft magnetic particles involves forming, in advance, a silicon oxide-based insulating coating on the surface of each type of soft magnetic particles. The technique also involves the steps of: mixing the particles with a resin for pressing to form granules; then performing a first heat treatment to form a compact and to vaporize the resin for molding; and then performing a second heat treatment in a non-oxidative atmosphere for preventing the production of an oxide phase. Thus, the conventional technique using two types of soft magnetic particles involves complicated steps for forming a magnetic core.

It is an object of the invention, which has been accomplished in view of the above problems, to provide a magnetic core having high manufacturability and high magnetic permeability, to provide a method for manufacturing such a magnetic core, and to provide a coil component having such a magnetic core.

Means for Solving the Problems

The invention is directed to a magnetic core including:

Fe-based soft magnetic alloy particles; and an oxide phase existing between the Fe-based soft magnetic alloy particles, wherein the Fe-based soft magnetic alloy particles include Fe—Al—Cr alloy particles and Fe—Si—Al alloy particles.

In the magnetic core, the Fe-based soft magnetic alloy particles include Fe—Si—Al alloy particles and Fe—Al—Cr alloy particles, which have higher formability than the Fe—Si—Al alloy particles. During pressing, therefore, the Fe—Al—Cr alloy particles are plastically deformed so that they can fill voids between the Fe—Si—Al alloy particles and increase the density. This allows the resulting magnetic core to have reduced non-magnetic voids and improved magnetic permeability.

The oxide phase is preferably richer in Al than the Fe-based soft magnetic alloy particles. Since Al is contained in both types of Fe-based soft magnetic alloy particles, an Al-rich oxide phase can be formed between the Fe-based soft magnetic alloy particles. This provides good insulating properties. The oxide phase also allows the Fe-based soft magnetic alloy particles to be bonded together.

The magnetic core preferably has a density of $5.4\times10^3$ kg/m$^3$ or more. The magnetic core with a density increased to a value in such a range can have higher strength and magnetic permeability.

In the magnetic core, the Fe-based soft magnetic alloy particles preferably have an average particle size (d50) of 20 μm or less. The magnetic core with an average particle size of the Fe-based soft magnetic alloy particles in this range can have reduced eddy-current loss at high frequency.

The invention is also directed to a method for manufacturing the magnetic core, the method including the steps of:

pressing a mixed powder including an Fe—Al—Cr alloy powder and an Fe—Si—Al alloy powder to form a compact; and heat-treating the compact to form the oxide phase.

The manufacturing method includes pressing a mixed powder including an Fe—Si—Al alloy powder and an Fe—Al—Cr alloy powder, which has higher formability than the former. This feature makes it possible to fill voids between alloy particles and thus to increase density. In addition, the heat treatment successfully forms an Al-containing oxide phase between the Fe-based soft magnetic alloy particles to increase the insulating properties of the magnetic core.

The invention also encompasses a coil component including the magnetic core and a coil provided on the magnetic core.

Using the magnetic core, coil components can be manufactured with high productivity. Using the magnetic core, coil components with high magnetic permeability can also be obtained.

MODE FOR CARRYING OUT THE INVENTION

Hereinafter, a magnetic core according to an embodiment of the invention, a method according to an embodiment of the invention for manufacturing the magnetic core, and a coil component according to an embodiment of the invention will be described specifically. It will be understood that they are not intended to limit the invention. Note that parts unnecessary for description are omitted from some or all of the drawings and some parts are illustrated in an enlarged, reduced, or modified manner for easy understanding.

<<Magnetic Core>>

Figure 1A:
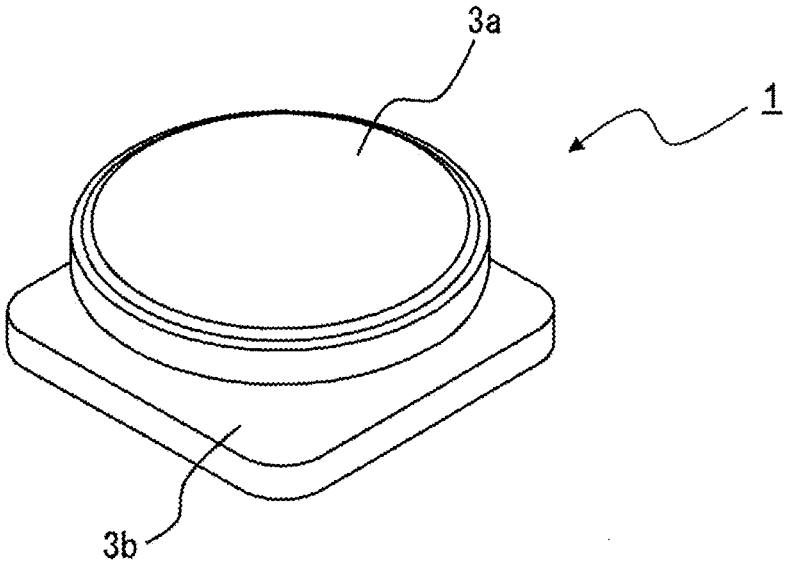
FIG. 1A is a perspective view schematically showing a magnetic core according to an embodiment of the invention.
Figure 1B:
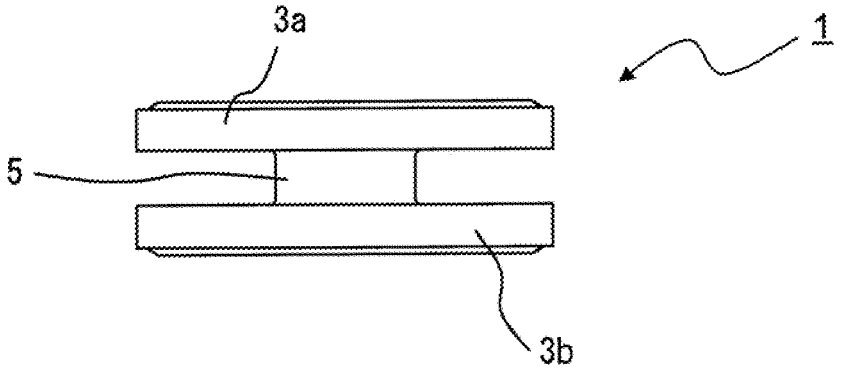
FIG. 1B is a front view schematically showing the magnetic core according to an embodiment of the invention.

FIG. 1A is a perspective view schematically showing the magnetic core of the embodiment, and FIG. 1B is a front view of it. The magnetic core 1 includes a cylindrical coil holding part 5 on which a coil is to be wound; and a pair of flanges 3*a* and 3*b* opposed to each other and provided at both ends of the cold holding part 5. The magnetic core 1 has a drum-shaped appearance. The coil holding part 5 may have a circular cross-sectional shape or any other cross-sectional shape such as a square, rectangular, or elliptical shape. The coil holding part 5 may be provided with flanges at both ends or provided with a flange only at one end.

The magnetic core of the embodiment includes Fe-based soft magnetic alloy particles and an oxide phase existing between the Fe-based soft magnetic alloy particles, wherein the Fe-based soft magnetic alloy particles include Fe—Al—Cr alloy particles and Fe—Si—Al alloy particles. The oxide phase is richer in Al than the Fe-based soft magnetic alloy particles.

(Fe—Al—Cr Alloy Particles)

The Fe—Al—Cr alloy particles, which have high contents of three main elements: Fe, Cr, and Al, may have any composition capable of forming a magnetic core. Al and Cr are elements capable of improving corrosion resistance and other properties. In addition, Al can particularly contribute to the formation of a surface oxide. From these points of view, the content of Al in the Fe—Al—Cr alloy particles is preferably 2.0% by weight or more, more preferably 3.0% by weight or more. On the other hand, too high an Al content can reduce the saturation magnetic flux density. Therefore, the Al content is preferably 10.0% by weight or less, more preferably 8.0% by weight or less, even more preferably 7.0% by weight or less. As mentioned above, Cr is an element capable of improving corrosion resistance. From this point of view, the content of Cr in the Fe—Al—Cr alloy particles is preferably 1.0% by weight or more, more preferably 2.5% by weight or more. On the other hand, too high a Cr content can reduce the saturation magnetic flux density and make the alloy particles too hard. Therefore, the Cr content is preferably 9.0% by weight or less, more preferably 7.0% by weight or less.

In view of the corrosion resistance and other properties, the total content of Cr and Al is preferably 6.0% by weight or more. The surface oxide layer is significantly richer in Al than in Cr. Therefore, it is preferable to use an Fe—Al—Cr alloy powder with an Al content higher than its Cr content.

The remainder other than Cr and Al is composed mainly of Fe. The remainder may also contain any other elements as long as the good formability and other advantages of the Fe—Al—Cr alloy particles can be obtained. It should be noted that the content of non-magnetic elements is preferably 1.0% by weight or less because of their ability to reduce the saturation magnetic flux density and other values. If having a high Si content, the Fe—Al—Cr alloy particles can be too hard. In the embodiment, therefore, the Si content is preferably as low as the content of inevitable impurities (preferably 0.5% by weight or less), which can be introduced through a normal process of manufacturing an Fe—Al—Cr alloy powder. The Fe—Al—Cr alloy particles are more preferably composed of Fe, Cr, and Al except for inevitable impurities.

(Fe—Si—Al Alloy Particles)

The Fe—Si—Al alloy particles, which have high contents of three main elements: Fe, Si, and Al, may have any composition capable of forming a magnetic core. Fe-9.5Si-5.5Al alloy particles are a typical example of the Fe—Si—Al alloy particles. In order to achieve low core loss and high magnetic permeability, the Fe—Si—Al alloy preferably has a Si content of about 5% by weight to about 11% by weight and an Al content of about 3% by weight to about 8% by weight. The Fe—Si—Al alloy particles with this composition are relatively hard and resist deformation by pressure during pressing. In the embodiment, however, the Fe—Si—Al alloy powder is mixed with the Fe—Al—Cr alloy powder, which has good formability, so that a magnetic core with high density and high magnetic permeability can be easily and efficiently formed by pressing.

(Alloy Particle Contents)

Although being a magnetic material with high magnetic permeability, the Fe—Si—Al alloy may form a magnetic core with a large number of voids due to its high hardness. The voids may function as magnetic gaps in the magnetic path. Therefore, the magnetic permeability varies with the number of voids. In the magnetic core of the embodiment, however, as the content of the Fe—Al—Cr alloy particles increases, the number of voids decreases, so that the magnetic permeability of the magnetic core increases. Therefore, as to the contents of the Fe—Al—Cr alloy particles and the Fe—Si—Al alloy particles, the content of the Fe—Al—Cr alloy particles should be increased to a level at which the desired properties can be obtained. The content of the Fe—Al—Cr alloy particles is preferably 20% by weight or more, more preferably 25% by weight or more, even more preferably 50% by weight or more, based on the total weight of the Fe—Al—Cr alloy particles and the Fe—Si—Al alloy particles. As the content of the Fe—Al—Cr alloy particles increases, the strength of the magnetic core increases. The upper limit of the content of the Fe—Al—Cr alloy particles may be set at any suitable level, which may be 99.5% by weight, 99% by weight, or 95% by weight. On the other hand, in order to reduce an increase in core loss, the content of the Fe—Al—Cr alloy particles is more preferably 90% by weight or less based on the total weight of the Fe—Al—Cr alloy particles and the Fe—Si—Al alloy particles.

(Average Particle Size of Alloy Particles)

The Fe-based soft magnetic alloy particles may have any average particle size (in this case, any median diameter d50 in the cumulative particle size distribution). The strength and high-frequency properties of the magnetic core can be improved by reducing the average particle size. Therefore, for example, an Fe-based soft magnetic alloy powder with an average particle size of 20 μm or less is preferably used in applications where high-frequency properties are required. The median diameter d50 is more preferably 18 μm or less, even more preferably 16 μm or less. On the other hand, the magnetic permeability can decrease with decreasing average particle size. Therefore, the median diameter d50 is more preferably 5 μm or more. In addition, coarse particles are preferably removed from the soft magnetic alloy powder using a sieve or other means. In this case, a soft magnetic alloy powder with particle sizes of at least under 32 μm (in other words, having passed through a sieve with an aperture of 32 μm) is preferably used.

In order to achieve close packing, the average particle size of the Fe-based soft magnetic alloy particles may differ between the Fe—Si—Al alloy particles and the Fe—Al—Cr alloy particles, depending on their contents and other conditions.

(Oxide Phase)

In the magnetic core of the embodiment, an oxide phase exists between the Fe-based soft magnetic alloy particles, and the oxide phase is richer in Al than the region of the Fe-based soft magnetic alloy particles. When the magnetic core obtained after the heat treatment of the compact is subjected to cross-sectional observation and analysis of each constituent element using scanning electron microscope/energy dispersive X-ray spectroscopy (SEM/EDX), it is observed that an Al-rich oxide phase is formed between the Fe-based soft magnetic alloy particles. The oxide phase is composed mainly of a phase including Al oxide as a main component and Fe, Cr, and Si. Besides this phase, the oxide phase may contain a phase including Fe oxide, Cr oxide, or Si oxide as a main component.

When the Fe-based soft magnetic alloy particles are oxidized by the heat treatment described below, the oxide phase is formed on the surface of the Fe-based soft magnetic alloy particles. In this process, Al migrates from the Fe—Si—Al alloy particles and the Fe—Al—Cr alloy particles to form an Al-rich surface layer, so that the resulting oxide phase has an Al content higher than that of the alloy phase in the particles of each alloy. The formation of the oxide increases the insulation between the soft magnetic alloy particles and the corrosion resistance of the soft magnetic alloy particles. In addition, the oxide phase, which is formed after the formation of the compact, can contribute to the bonding between the soft magnetic alloy particles by existing between them. The soft magnetic alloy particles bonded together with the oxide phase between them allow the resulting magnetic core to have high strength. The element distribution can be observed from the SEM image.

(Properties of Magnetic Core)

The magnetic core of the embodiment has high formability and is advantageous in achieving high magnetic core strength and high magnetic permeability. In addition, the oxide phase ensures insulating properties to make the magnetic core sufficient in terms of core loss properties.

The density of the magnetic core is preferably as high as possible in order to improve the strength and the magnetic permeability. After heat-treated, the magnetic core preferably has a density of $5.4\times10^3$ kg/m$^3$ or more, more preferably $5.5\times10^3$ kg/m$^3$ or more, even more preferably $5.8\times10^3$ kg/m$^3$ or more. In the magnetic core of the embodiment, an Fe—Si—Al alloy powder with relatively high hardness is mixed with an Fe—Al—Cr alloy powder with good formability, which makes it possible to increase the filling factor of the compact and to increase the density of the magnetic core.

<<Method for Manufacturing Magnetic Core>>

A method for manufacturing the magnetic core of the embodiment includes the steps of pressing a mixed powder including an Fe—Al—Cr alloy powder and an Fe—Si—Al alloy powder to form a compact (the compact-forming step) and heat-treating the compact to form the oxide phase described above (the heat-treating step). An Fe—Al—Cr alloy powder and an Fe—Si—Al alloy powder are used as Fe-based soft magnetic alloy powders. In the heat-treating step, the oxide phase is formed on the surface of Fe-based soft magnetic alloy particles. The resulting oxide phase has a higher Al content in mass ratio than the alloy phase inside the particles.

(Compact-Forming Step)

The Fe—Al—Cr alloy powder containing Cr and Al is more plastically deformable than the Fe—Si—Al alloy powder. Therefore, the Fe—Al—Cr alloy powder can form a magnetic core with high density and strength even under low pressure. This makes it possible to avoid the use of a large and/or complicated pressing machine. In addition, the pressing can be performed under low pressure, which can prevent damage to the die and improve the productivity.

In addition, the use of the Fe—Al—Cr alloy powder as a soft magnetic alloy powder makes it possible to form an insulating oxide on the surface of soft magnetic alloy particles by the heat treatment after the pressing as described below. This makes it possible to omit the step of forming an insulating oxide before the pressing and to simplify the method of forming an insulating coating, so that the productivity can be improved.

The Fe-based soft magnetic alloy powder may be in any form. In view of fluidity and other properties, a granular powder such as an atomized powder is preferably used. An atomization method such as gas atomization or water atomization is suitable for the production of a powder of an alloy that has high malleability or ductility and is hard to grind. An atomization method is also advantageous for obtaining substantially spherical particles of soft magnetic alloys.

In the embodiment, when compression molding is performed, a binder is preferably added to bind particles in the mixed powder of the Fe-based soft magnetic alloys and to impart, to the compact, a strength enough to withstand handling after the pressing. The binder may be of any type. For example, any of various organic binders such as polyethylene, polyvinyl alcohol, and acrylic resin may be used. Organic binders are thermally decomposed by the heat treatment after the pressing. Therefore, an inorganic binder, such as a silicone resin, capable of remaining as a solid and binding the particles even after the heat treatment may be used in combination with an organic binder. In the magnetic core manufacturing method according to the embodiment, however, the oxide phase formed in the heat-treating step can function to bind the Fe-based soft magnetic alloy particles. Therefore, the process should preferably be simplified by omitting the use of the inorganic binder.

The content of the binder is preferably such that the binder can be sufficiently spread between the Fe-based soft magnetic alloy particles to ensure a sufficient compact strength. However, too high a binder content can reduce the density or strength. From these points of view, the binder content is preferably, for example, from 0.5 to 3.0 parts by weight based on 100 parts by weight of the Fe-based soft magnetic alloy powders.

An Fe—Al—Cr alloy powder and an Fe—Si—Al alloy powder are provided as Fe-based soft magnetic alloy powders and mixed in the ratio shown above to form a mixed powder. If necessary, the binder may be added to the mixed powder. In this step, the Fe-based soft magnetic alloy powders and the binder may be mixed by any method. A conventionally known mixing method or a conventionally known mixer may be used to mix them. When mixed with the binder, the mixed powder forms an aggregated powder with a wide particle size distribution due to the binding action of the binder. Therefore, the resulting mixed powder may be allowed to pass through a sieve, for example, using a vibrating sieve, so that a granulated powder with a desired secondary particle size suitable for molding can be obtained. In addition, a lubricant such as stearic acid or a stearic acid salt is preferably added to the granulated powder in order to reduce the friction between the powder and the die during the pressing. The content of the lubricant is preferably from 0.1 to 2.0 parts by weight based on 100 parts by weight of the Fe-based soft magnetic alloy powders. Alternatively, the lubricant may be applied to the die.

The resulting mixed powder is then pressed into a compact. Preferably, the mixed powder obtained by the above procedure is granulated as described above and then subjected to the pressing step. Using a pressing die, the granulated mixed powder is pressed into a predetermined shape such as a toroidal shape or a rectangular solid shape. The pressing may be room temperature pressing or warm pressing in which heating is performed to such an extent as not to eliminate the binder. During the pressing, the pressure is preferably 1.0 GPa or less. When the pressing is performed at low pressure, a magnetic core with high magnetic properties and high strength can be formed while the die is prevented from being broken or damaged. It will be understood that the above method of preparing the mixed powder and the above pressing method are not intended to be limiting.

(Heat-Treating Step)

Next, a description will be given of the heat-treating step, which includes heat-treating the compact obtained after the compact-forming step. The compact is subjected to a heat treatment for relaxing the stress/strain introduced by the pressing or the like so that good magnetic properties can be obtained. The heat treatment also forms an Al-rich oxide phase on the surface of the Fe-based soft magnetic alloy particles. The oxide phase is grown by the reaction of oxygen with the Fe-based soft magnetic alloy particles in the heat treatment. The oxide phase is formed by the oxidation reaction, which proceeds beyond the natural oxidation of the Fe-based soft magnetic alloy particles. The heat treatment may be performed in an oxygen-containing atmosphere such as the air or a mixed gas of oxygen and inert gas. The heat treatment may also be performed in a water vapor-containing atmosphere such as a mixed gas of water vapor and inert gas. Among them, the heat treatment in the air is simple and preferred.

In this step, the heat treatment may be performed at a temperature that allows the oxide phase to be formed. The heat treatment makes it possible to obtain a high-strength magnetic core. In this step, the heat treatment is also preferably performed at a temperature that does not allow significant sintering of the Fe-based soft magnetic alloy powders. If the Fe-based soft magnetic alloy powders are significantly sintered, necking can occur between alloy particles so that part of the Al-rich (high Al content) oxide phase can be surrounded by the alloy phase and thus isolated in the form of an island. In this case, the function of the oxide phase to separate alloy phases from one another in the matrix of soft magnetic alloy particles can decrease, and the core loss can also increase. Specifically, the heat treatment temperature is preferably in the range of 600 to 900° C., more preferably in the range of 700 to 800° C., even more preferably in the range of 750 to 800° C. The holding time in the above temperature range is appropriately set depending on the size of the magnetic core, the quantity to be treated, the tolerance for variations in properties, or other conditions. The holding time is set to, for example, 0.5 to 3 hours.

(Other Steps)

The manufacturing method of the embodiment may further include additional steps other than the compact-forming step and the heat-treating step. For example, the compact-forming step may be preceded by an additional preliminary step including forming an insulating coating on the Fe-based soft magnetic alloy powders by a heat treatment, a sol-gel method, or other methods. More preferably, however, this preliminary step should be omitted so that the manufacturing process can be simplified, because an oxide phase is successfully formed on the surface of the Fe-based soft magnetic alloy particles by the heat-treating step in the magnetic core manufacturing method according to the embodiment. The oxide phase itself also resists plastic deformation. Therefore, when the process used includes forming the Al-rich oxide phase after the pressing, the high formability of the Fe—Al—Cr alloy powder can be effectively utilized in the pressing.

<<Coil Component>>

Figure 2A:
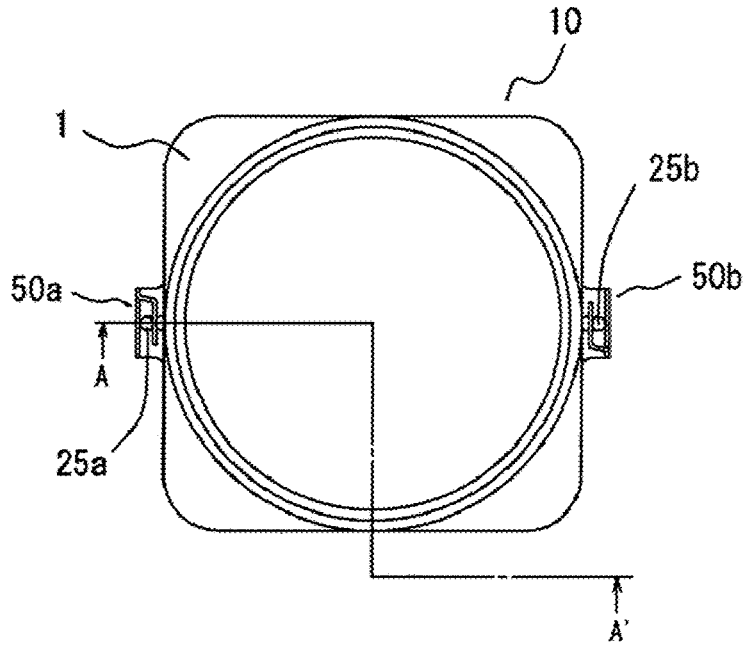
FIG. 2A is a plane view schematically showing a coil component according to an embodiment of the invention.
Figure 2B:
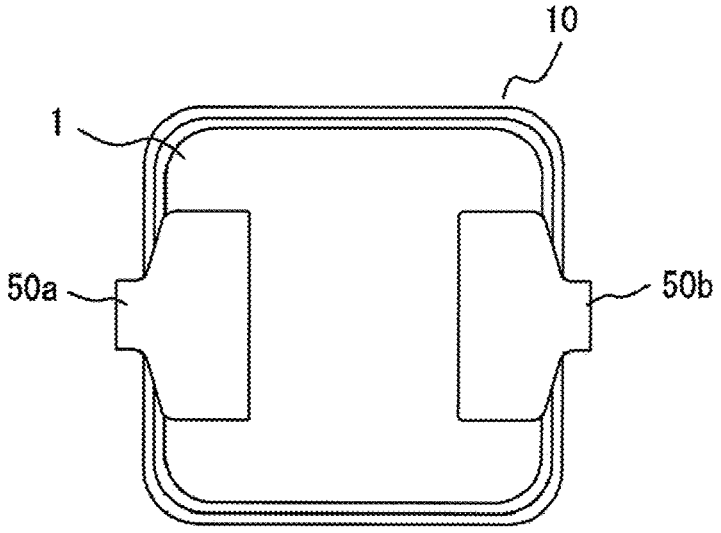
FIG. 2B is a bottom view schematically showing the coil component according to an embodiment of the invention.
Figure 2C:
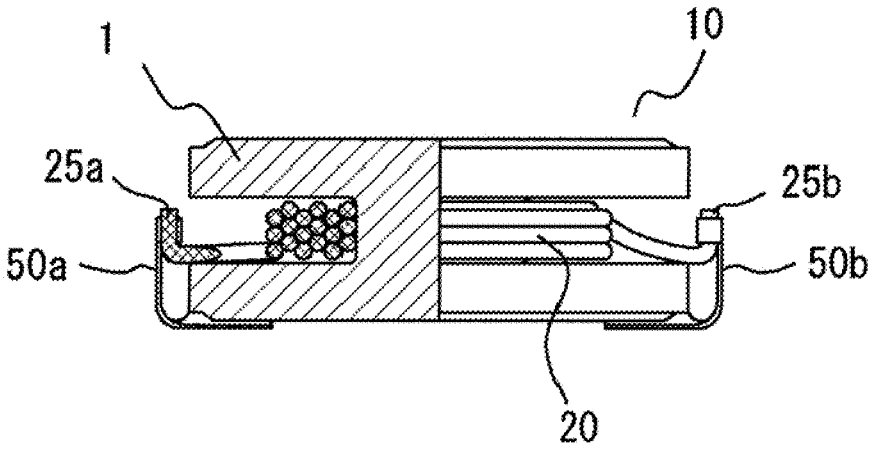
FIG. 2C is a partial cross-sectional view along the A-A' line in FIG. 2A.

FIG. 2A is a plane view schematically showing a coil component according to the embodiment. FIG. 2B is a bottom view of the coil component, and FIG. 2C is a partial cross-sectional view along the A-A' line in FIG. 2A. The coil component 10 includes a magnetic core 1 and a coil 20 wound on the coil holding part 5 of the magnetic core 1. On the mount surface of the flange 3*b* of the magnetic core 1, metal terminals 50*a* and 50*b* are provided at edges located symmetrically about the center of gravity between them. One free end of each of the metal terminals 50*a* and 50*b* vertically rises in the height direction of the magnetic core 1 out of the mount surface. The rising free ends of the metal terminals 50*a* and 50*b* are joined to the ends 25*a* and 25*b* of the coil, respectively, so that they are electrically connected. The coil component having the magnetic core and the coil in this manner may be used as, for example, a choke, an inductor, a reactor, or a transformer.

The magnetic core may be manufactured in the form of a simple magnetic core, which is obtained through pressing of only a mixture including the soft magnetic alloy powders, the binder, and other components as described above, or may be manufactured to have a structure in which the coil is disposed in the interior. As a non-limiting example, the magnetic core with the latter structure may be manufactured using a method of integrally compression-molding the soft magnetic alloy powders and the coil or may be manufactured as a coil-sealed structure using a lamination process such as sheet lamination or printing.

EXAMPLES

Hereinafter, preferred examples of the invention will be illustratively described in detail. It will be understood that unless otherwise stated, the materials, the contents, and other conditions shown in the examples are not intended to limit the gist of the invention.

<Preparation of Magnetic Core>

A magnetic core was prepared as described below. An Fe—Al—Cr alloy powder and an Fe—Si—Al alloy powder (Alloy Powder PF18 manufactured by EPSON ATMIX Corporation) were used as Fe-based soft magnetic alloy powders. The average particle size (median diameter d50) of the soft magnetic alloy powder measured using a laser diffraction scattering particle size distribution analyzer (LA-920 manufactured by HORIBA, Ltd.) was 16.8 μm for the Fe—Al—Cr alloy powder and 9 μm for the Fe—Si—Al alloy powder. The Fe—Al—Cr alloy powder was an atomized granular powder with a composition of Fe-5.0% Al-4.0% Cr in mass percentage. The Fe—Si—Al alloy powder was also an atomized granular powder with a composition of Fe-9.8% Si-6.0% Al in mass percentage.

The Fe—Al—Cr alloy powder and the Fe—Si—Al alloy powder were mixed in a predetermined ratio. To 100 parts by weight of the mixed powder was added 2.5 parts by weight of an acrylic resin-based emulsion binder (Polysol AP-604, 40% in solids content, manufactured by SHOWA HIGH-POLYMER CO., LTD.). The resulting mixed powder was dried at 120° C. for 10 hours. The dried mixed powder was allowed to pass through a sieve, so that a granulated powder was obtained. On the basis of 100 parts by weight of the soft magnetic alloy powders, 0.4 parts by weight of zinc stearate was added to the granulated powder and mixed to form a mixture for molding.

Figure 3:
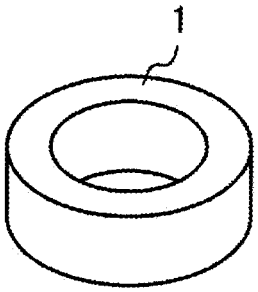
FIG. 3 is a perspective view schematically showing a toroidal magnetic core prepared in an example.

The resulting mixed powder was pressed under a pressure of 0.91 GPa at room temperature using a press, so that a toroidal compact as shown in FIG. 3 was obtained. The compact was then heat-treated in the air at a temperature of 750° C. for 1 hour to form a magnetic core (each of Sample Nos. 1 to 4). The external dimensions of the magnetic core were 13.4 mmφ in outer diameter, 7.74 mmφ in inner diameter, and 4.3 mm in height.

For comparison, a magnetic core with the same shape and size as those shown above was obtained under the same conditions of mixing, pressing, and heat treatment, except that only an Fe—Si—Al alloy powder was used as a soft magnetic alloy powder with no Fe—Al—Cr alloy powder added (Sample No. 5).

<Evaluations>

Each magnetic core prepared by the above process was evaluated as described below. The evaluation results are shown in Table 1 and FIGS. 4 to 9, 10A to 10F, and 11A to 11E. FIGS. 4 to 9 are each a graphic illustration showing the correlation between Fe—Al—Cr alloy powder content and each evaluation item in the example. FIGS. 10A to 10F are SEM images of the cross-section of the magnetic core of Sample No. 3 in the example. FIGS. 11A to 11E are SEM images of the cross-section of the magnetic core of Sample No. 5 in the example.

(Measurement of Density)

The density (kg/m$^3$) of each magnetic core was calculated from its dimensions and mass.

(Measurement of Radial Crushing Strength)

The maximum breaking load P (N) was measured under a load applied in the diameter direction onto the circumference surface of the toroidal magnetic core, and the radial crushing strength σr (MPa) was calculated from the following formula:

$$\sigma r = P(D-d)/(Id^2)$$

wherein D is the outer diameter (mm) of the core, d is the thickness (mm) of the core, and I is the height (mm) of the core.

(Measurement of Magnetic Permeability (Initial Magnetic Permeability μi))

A coil component was formed by winging 30 turns of a wire on the toroidal magnetic core. The inductance L of the coil component was measured with 4285A manufactured by Hewlett-Packard Company, and the initial magnetic permeability μi was calculated from the following formula:

$$\mu i = (1e \times L)/(\mu_0 \times Ae \times N^2)$$

wherein 1e is the magnetic path length (m), L is the inductance (H) of the sample, $\mu_0$ is the magnetic permeability of vacuum=$4\pi \times 10^{-7}$ (H/m), Ae is the cross-sectional area (m$^2$) of the magnetic core, and N is the number of turns in the coil.

(Measurement of Magnetic Core Loss (Core Loss))

A coil component was formed by winging 15 turns of a wire on each of the primary and secondary sides of the toroidal magnetic core. The core loss of the coil component was then measured under the conditions of a maximum magnetic flux density of 30 mT and a frequency of 300 kHz using B-H Analyzer SY-8232 manufactured by IWATSU TEST INSTRUMENTS CORPORATION.

(Measurement of Resistivity)

A disk-shaped magnetic core (13.5 mmφ in outer diameter, 4 mm in thickness) was prepared as a sample to be measured. A conductive adhesive was applied to the two opposite flat surfaces of the sample. After the adhesive was solidified by drying, the sample was placed between electrodes. Using an electric resistance meter (8340A manufactured by ADC Corporation), the resistance R (Ω) of the sample was measured under the application of a DC voltage of 50 V. The flat surface area A ($m^2$) and thickness t (m) of the sample were measured, and the resistivity ρ (Ωm) of the sample was calculated from the following formula:

$$\text{resistivity } \rho\ (\Omega\text{m}) = R \times (A/t)$$

(Structure Observation and Composition Distribution)

The toroidal magnetic core was cut, and the resulting cross-section was observed with a scanning electron microscope (SEM/EDX) (magnification: 2,000×).

TABLE 1

| Sample No. | Content (wt %) Fe—Al—Cr | Fe—Al—Si | Density ($\times 10^3$ kg/$m^3$) Compact | After heat treatment | Radial crushing strength (MPa) | Initial magnetic permeability μi | Core loss (kW/$m^3$) at 300 kHz 30 mT Pcv | Eddy-current loss Pev | Hysteresis loss Phv | Resistivity (kΩm) at 50 V |
|---|---|---|---|---|---|---|---|---|---|---|
| 1 | 90 | 10 | 6.12 | 6.32 | 208 | 52.6 | 453 | 48 | 404 | 11.2 |
| 2 | 75 | 25 | 5.91 | 6.09 | 169 | 45.6 | 409 | 48 | 359 | 5.6 |
| 3 | 50 | 50 | 5.59 | 5.77 | 112 | 38.4 | 328 | 50 | 274 | 12.1 |
| 4 | 25 | 75 | 5.28 | 5.48 | 89 | 34.1 | 254 | 43 | 208 | 67.4 |
| 5 | 0 | 100 | 5.00 | 5.20 | 57 | 31.0 | 194 | 49 | 144 | 492.9 |

Figure 4:
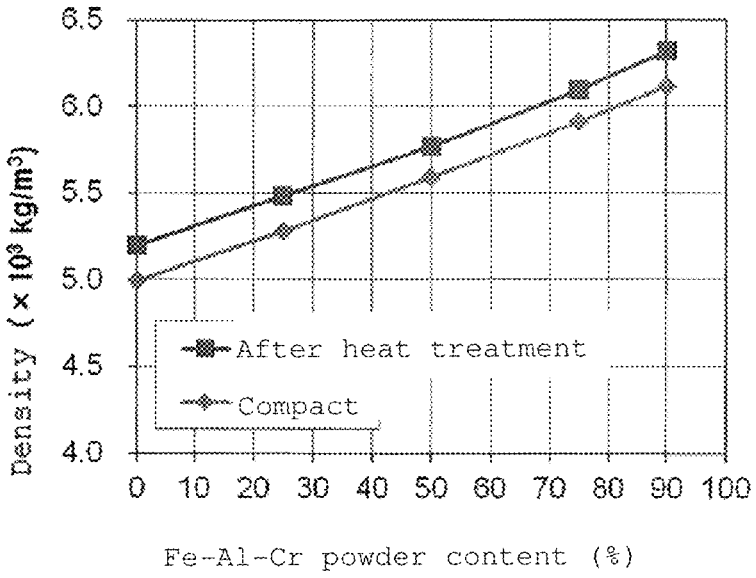
FIG. 4 is a graphic illustration showing the correlation between Fe—Al—Cr alloy powder content and the density of magnetic cores in the example.
Figure 5:
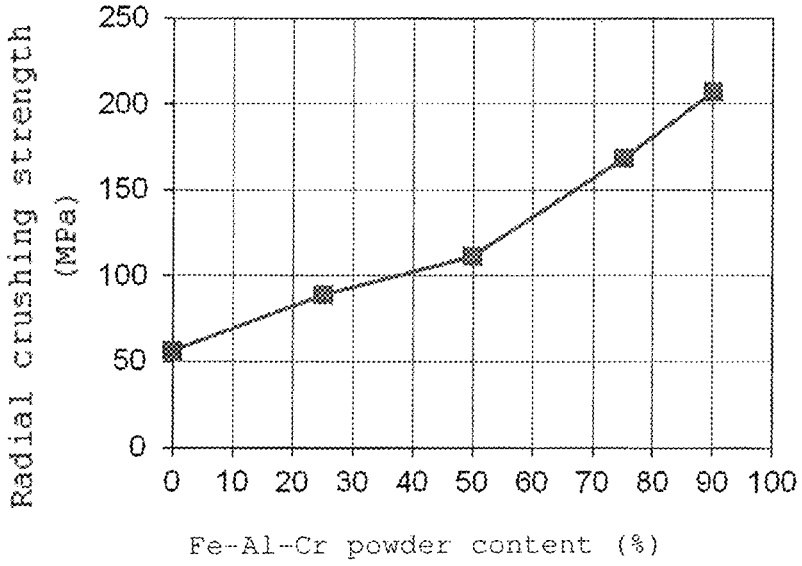
FIG. 5 is a graphic illustration showing the correlation between Fe—Al—Cr alloy powder content and the radial crushing strength of magnetic cores in the example.
Figure 6:
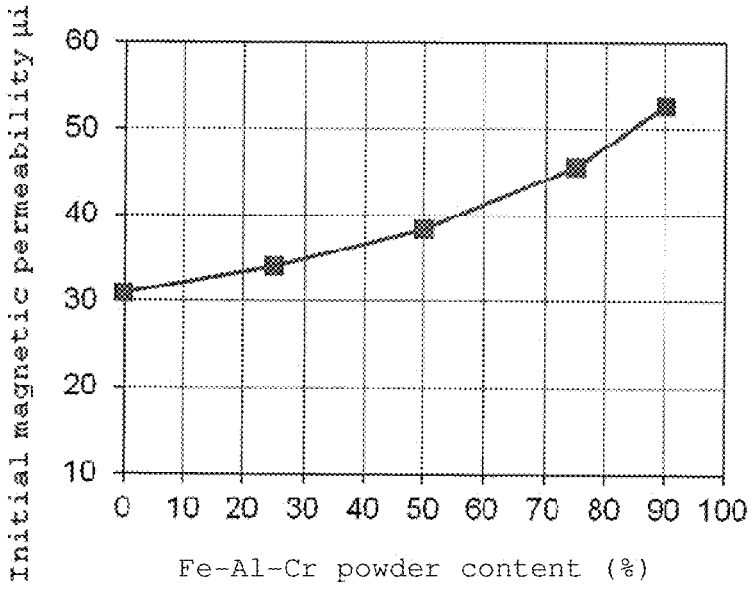
FIG. 6 is a graphic illustration showing the correlation between Fe—Al—Cr alloy powder content and the initial magnetic permeability of magnetic cores in the example.
Figure 7:
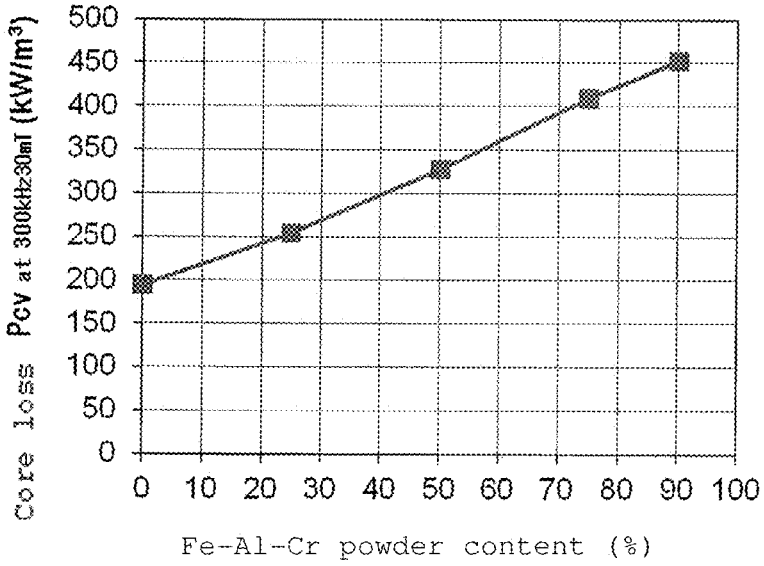
FIG. 7 is a graphic illustration showing the correlation between Fe—Al—Cr alloy powder content and the core loss of magnetic cores in the example.
Figure 8:
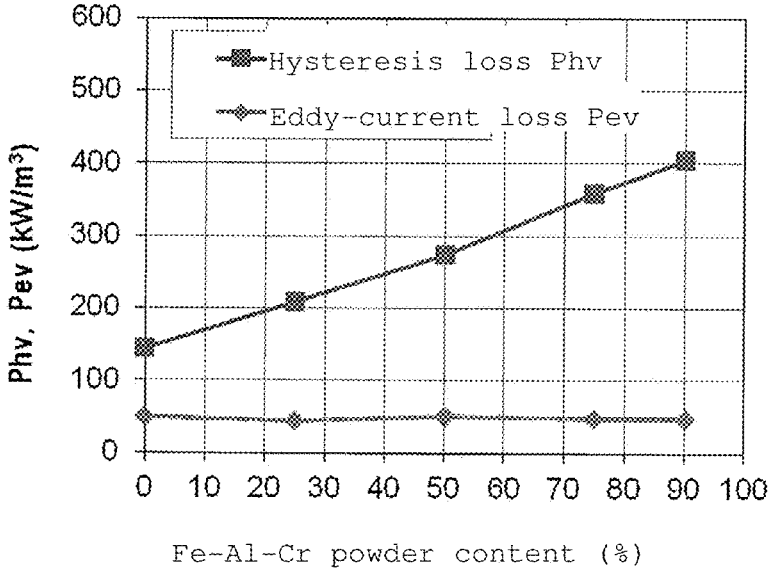
FIG. 8 is a graphic illustration showing the correlation between Fe—Al—Cr alloy powder content and the eddy-current loss and hysteresis loss of magnetic cores in the example.
Figure 9:
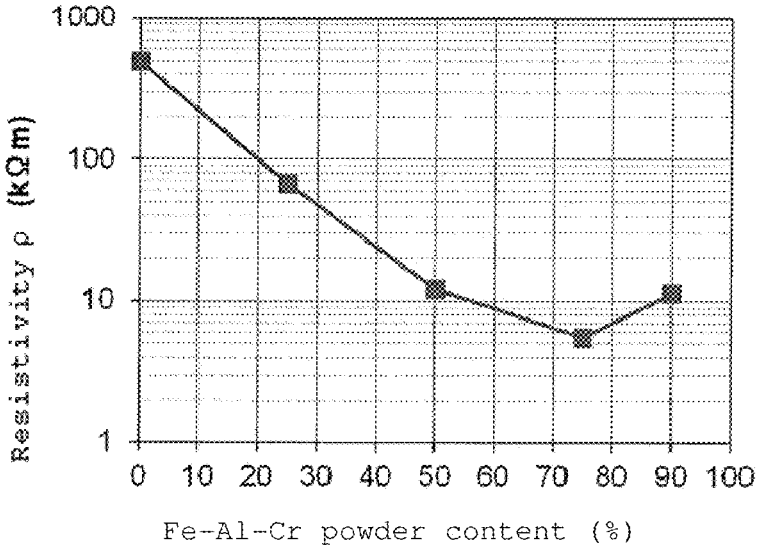
FIG. 9 is a graphic illustration showing the correlation between Fe—Al—Cr alloy powder content and the resistivity of magnetic cores in the example.

Table 1 and FIGS. 4 to 6 show that the magnetic cores of Nos. 1 to 4 each prepared with an Fe—Al—Cr alloy powder and an Fe—Si—Al alloy powder have a significantly higher level of radial crushing strength and magnetic permeability than the magnetic core of No. 5 prepared with an Fe—Si—Al alloy powder alone. It has been found that the features of the example are very advantageous in achieving high radial crushing strength and high magnetic permeability. According to the features of the example, magnetic cores having high strength and high magnetic permeability were successfully provided using simple pressing. FIGS. 4 to 6 also show that the Fe—Al—Cr alloy powder content correlates well with the radial crushing strength and the magnetic permeability. Therefore, magnetic cores with desired properties can be efficiently produced only by controlling the content of the Fe—Al—Cr alloy powder.

The core losses of all the magnetic cores according to the example are practically acceptable levels less than 500 kW/$m^3$, although the core loss (specifically the hysteresis loss) increases as the content of the Fe—Al—Cr alloy powder increases. The resistivities of all the magnetic cores according to the example are also practically acceptable levels more than 5 kΩm, although the resistivity decreases as the content of the Fe—Al—Cr alloy powder increases.

Figure 10A:
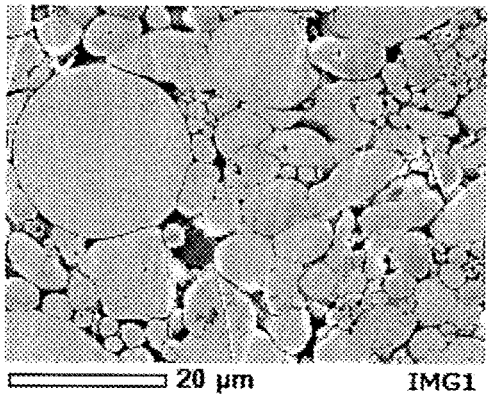
FIG. 10A is a scanning electron microscope (SEM) image of the cross-section of the magnetic core of Sample No. 3 in the example.
Figure 10B:
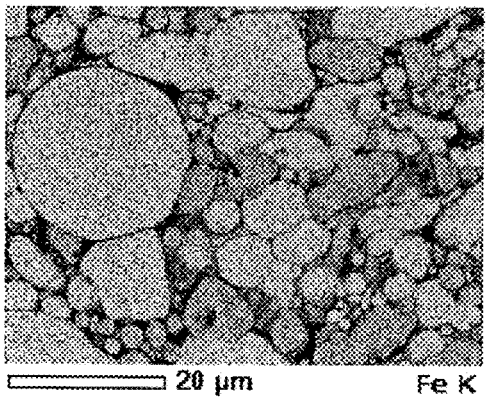
FIG. 10B is an SEM image of the cross-section of the magnetic core of Sample No. 3 in the example.
Figure 10C:
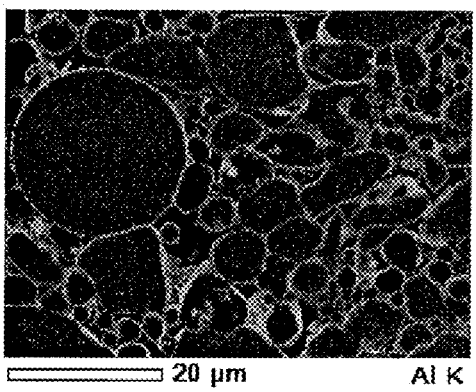
FIG. 10C is an SEM image of the cross-section of the magnetic core of Sample No. 3 in the example.
Figure 10D:
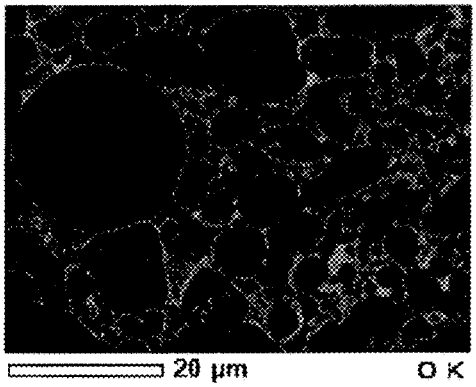
FIG. 10D is an SEM image of the cross-section of the magnetic core of Sample No. 3 in the example.
Figure 10E:
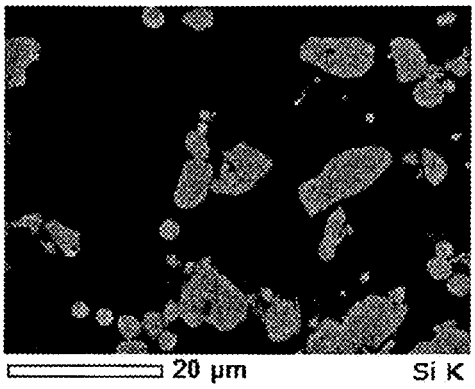
FIG. 10E is an SEM image of the cross-section of the magnetic core of Sample No. 3 in the example.
Figure 10F:
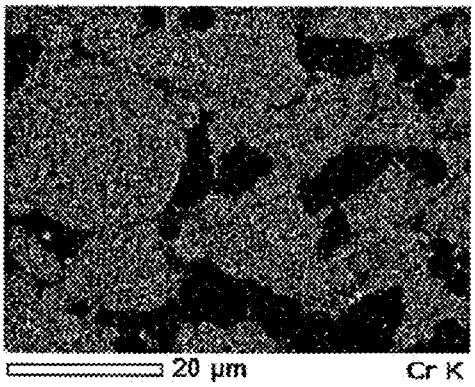
FIG. 10F is an SEM image of the cross-section of the magnetic core of Sample No. 3 in the example.

FIG. 10A shows the results of the evaluation of the magnetic core of No. 3 by the cross-sectional observation using a scanning electron microscope (SEM/EDX). FIGS. 10B to 10F each show the results of the evaluation of the magnetic core of No. 3 with respect to the distribution of each constituent element. FIG. 10A shows that due to the presence of Fe—Al—Cr alloy particles, there are observed many regions where alloy particles are plastically deformed so that alloy particles are in more intimate contact with one another with reduced voids between alloy particles.

FIGS. 10B to 10F are mappings showing the distributions of iron (Fe), aluminum (Al), oxygen (O), silicon (Si), and chromium (Cr), respectively. The brighter color tone indicates the higher content of the object element. Therefore, whether Al-rich regions are formed in the example can be visually determined in a simple manner based on whether or not the brightness for Al in the region occupied by the oxide phase is higher than the brightness for Al in the region occupied by alloy particles in the observed image of the element distribution. The presence or absence and extent of the Al-rich region can also be quantitatively evaluated by detailed analysis (such as SEM/EDX measurement for a longer time) of the Al content of the necessary parts in the alloy particles and the oxide phase. It is apparent from FIG. 10D that surfaces of the Fe-based soft magnetic alloy particles are oxygen-rich and form an oxide and that the Fe-based soft magnetic alloy particles are bonded together with the oxide between them. It is also apparent from FIG. 10C that the concentration of Al is significantly higher in the surface of the soft magnetic alloy particles. From these facts, it has been found that an oxide phase with an Al content higher than that of the inner alloy phase is formed on the surface of the soft magnetic alloy particles.

Figure 11A:
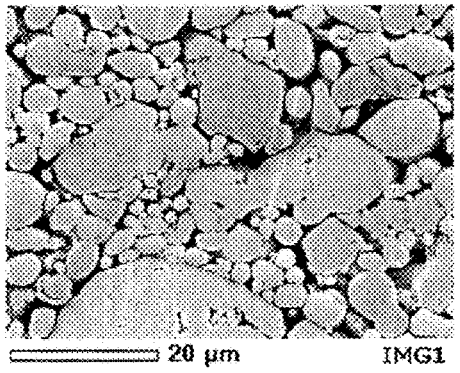
FIG. 11A is an SEM image of the cross-section of the magnetic core of Sample No. 5 in the example.
Figure 11B:
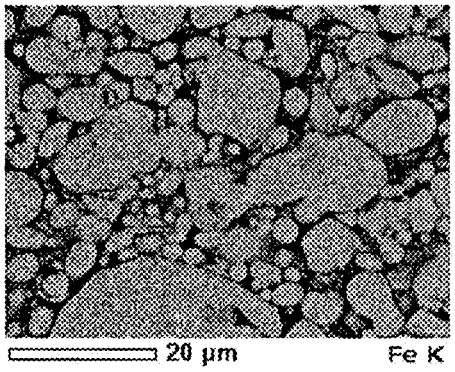
FIG. 11B is an SEM image of the cross-section of the magnetic core of Sample No. 5 in the example.
Figure 11C:
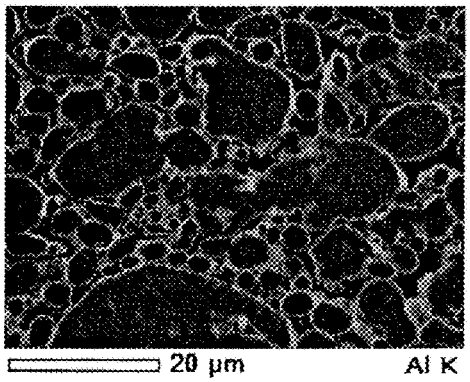
FIG. 11C is an SEM image of the cross-section of the magnetic core of Sample No. 5 in the example.
Figure 11D:
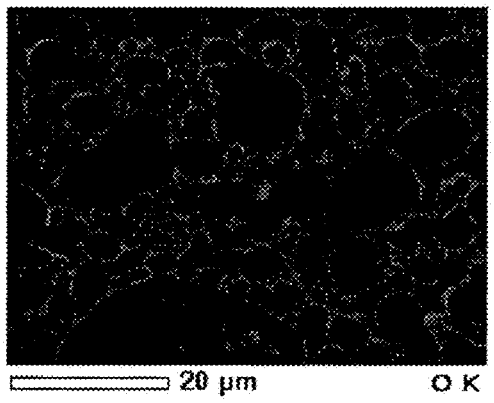
FIG. 11D is an SEM image of the cross-section of the magnetic core of Sample No. 5 in the example.
Figure 11E:
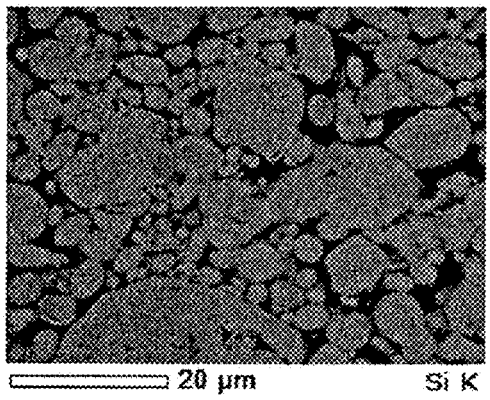
FIG. 11E is an SEM image of the cross-section of the magnetic core of Sample No. 5 in the example.

On the other hand, FIG. 11A shows the results of the evaluation of the magnetic core of No. 5 by the cross-sectional observation using a scanning electron microscope (SEM/EDX). It is apparent from FIG. 11A that due to the use of an Fe—Si—Al alloy powder alone, which is relatively hard and low in formability, there are observed many voids between alloy particles so that alloy particles are in less intimate contact with one another.

DESCRIPTION OF REFERENCE SIGNS

1 magnetic core
3*a*, 3*b* flange
5 coil holding part
10 coil component
20 coil
25*a*, 25*b* coil end
50*a*, 50*b* metal terminal

The invention claimed is:

1. A magnetic core comprising:

Fe-based soft magnetic alloy particles; and an oxide phase existing between the Fe-based soft magnetic alloy particles, wherein the Fe-based soft magnetic alloy particles comprise Fe—Al—Cr alloy particles and Fe—Si—Al alloy particles;

the Fe—Al—Cr alloy particles and the Fe—Si—Al alloy particles are bonded with the oxide phase; and the content of the Fe—Al—Cr alloy particles is 20% by weight or more based on the total weight of the Fe—Al—Cr alloy particles and the Fe—Si—Al alloy particles.

2. The magnetic core according to claim 1, wherein the oxide phase is richer in Al than the Fe-based soft magnetic alloy particles.

3. The magnetic core according to claim 1, which has a density of $5.4\times10^3$ kg/m$^3$ or more.

4. The magnetic core according to claim 1, wherein the Fe-based soft magnetic alloy particles have an average particle size of 20 μm or less.

5. A method for manufacturing the magnetic core according to claim 1, the method comprising the steps of:

pressing a mixed powder comprising an Fe—Al—Cr alloy powder and an Fe—Si—Al alloy powder to form a compact;

heat-treating the compact to form the oxide phase; and bonding the Fe—Al—Cr alloy particles and the Fe—Si—Al alloy particles with the oxide phase.

6. A coil component comprising:

the magnetic core according to claim 1; and a coil provided on the magnetic core.

7. The magnetic core according to claim 1, wherein the oxide phase includes an oxide of the Fe-based soft magnetic alloy particles.

8. The magnetic core according to claim 1, wherein the magnetic core comprises a cylindrical coil holding part and either (i) a flange only at one end of the coil holding part or (ii) flanges at both ends of the coil holding part.

9. The magnetic core according to claim 8, wherein the magnetic core comprises a cylindrical coil holding part and a flange only at one end of the coil holding part.

10. The magnetic core according to claim 8, wherein the magnetic core comprises a cylindrical coil holding part and flanges at both ends of the coil holding part.

* * * * *